US005171481A

United States Patent [19]

Yoshimura et al.

[11] Patent Number: 5,171,481

[45] Date of Patent: Dec. 15, 1992

[54] SYNTHETIC TRACTION FLUID

[75] Inventors: Narihiko Yoshimura; Hirotaka Tomizawa; Yasuji Komatsu, all of Saitama, Japan

[73] Assignee: Toa Nenryo Kogyo K.K., Tokyo, Japan

[21] Appl. No.: 832,632

[22] Filed: Feb. 7, 1992

Related U.S. Application Data

[63] Continuation of Ser. No. 252,775, Oct. 3, 1988, abandoned, which is a continuation of Ser. No. 55,240, May 28, 1987, abandoned.

[30] Foreign Application Priority Data

Jun. 10, 1986 [JP] Japan ..... 61-134401

[51] Int. Cl.[5] ..... C10M 101/04

[52] U.S. Cl. ..... 252/56 S; 560/1

[58] Field of Search ..... 252/56 S

[56] References Cited

U.S. PATENT DOCUMENTS 3,803,037 4/1974 Wygant ..... 252/32.7

FOREIGN PATENT DOCUMENTS 1000368 1/1957 Fed. Rep. of Germany .

1593113 7/1981 United Kingdom .

OTHER PUBLICATIONS

CA 99(4) 32543g Çurina D. L. J Chromatog. 260(1) 51-62 1983.

*Primary Examiner*—Paul J. Killos

*Attorney, Agent, or Firm*—R. A. Maggio; J. W. Ditsler

[57] ABSTRACT

A synthetic lubricating fluid comprising at least one ester or its derivative represented by the formula

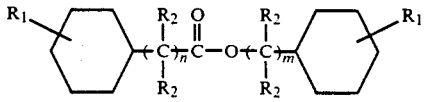

wherein:

n is an integer of 0 to 5 and m is an integer of 0 to 5, with the proviso that the sum of n+m is 1 to 10 inclusive;

$R_1$ is independently selected from hydrogen and $C_1$ to $C_8$ alkyl groups, and $R_2$ is independently selected from hydrogen and $C_1$ to $C_3$ alkyl groups.

13 Claims, No Drawings

SYNTHETIC TRACTION FLUID

This is a continuation of application Ser. No. 252,775, filed Oct. 3, 1988 abandoned; which was a Rule 60 continuation of Ser. No. 55,240, filed May 28, 1987 abandoned, which is based on Japanese Patent Application No. 134401/86, filed Jun. 10, 1986.

FIELD OF THE INVENTION

This invention relates to a synthetic lubricating fluid comprising a monoester compound of cyclohexanol with cyclohexanecarboxylic acid, or said ester and a branched poly-α-olefin incorporated therein.

BACKGROUND OF THE INVENTION

Traction drive power transmissions which transmit power to a driven part through a traction drive mechanism have attracted attention in the field of automobiles and industrial machinery, and in recent years extensive research and development has been conducted in this area. The traction drive mechanism is a power transmitting mechanism. Unlike conventional drive mechanisms it does not use any gears. This results in a reduction in vibration and noise as well as a smooth speed change in high-speed rotation. An important goal in the automobile industry is improvement in the fuel consumption of automobiles. It has been suggested that if the traction drive is applied to the transmission of automobiles in order to convert the transmission to a continuous variable-speed transmission the fuel consumption can be reduced by at least 20% compared with conventional transmission systems. This is due to the fact that the drive can always be in the optimum fuel consumption region of an engine. Recent studies have been conducted in the areas of development of materials having high fatigue resistance and theoretical analysis of traction mechanisms. Regarding the traction fluid, the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is required to be comprised of a lubricating oil having a high traction coefficient. It has been confirmed that a traction fluid possessing a molecular structure having a naphthene ring exhibits a high performance. "Santotrack®" manufactured by the Monsanto Chemical Company is widely known as a commercially available traction fluid. Japanese Patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated (α-methyl)styrene polymer, hydrindane compound or the like has a high traction coefficient. Japanese Patent Laid-Open No. 191797/1984 discloses a traction fluid containing an ester compound having a naphthene ring. It discloses that an ester obtained by the hydrogenation of the aromatic nucleus of dicyclohexyl cyclohexanedicarboxylate or dicyclohexyl phthalate is a preferred traction fluid.

As mentioned above the development of continuous variable-speed transmissions has advanced in recent years. The higher the traction coefficient of the traction fluid the larger the transmission force. This allows a reduction in the size of the device which in turn results in a reduction in emission of polluting exhaust gases. Therefore, there is a strong demand for a fluid having a traction coefficient which is as high as possible. However, the use of a conventional traction fluid which exhibits the highest performance of all the currently commercially available fluids in such a traction drive device provides unsatisfactory performance with respect to the traction coefficient. Such conventional fluids are also expensive. The traction fluid which has been proposed in Japanese Patent Publication No. 35763/1971 contains Santotrack® or its analogue as a component and, therefore, is also unsatisfactory with respect to performance and cost.

The present inventors have made extensive and intensive studies with a view to developing a traction fluid which not only exhibits a high traction coefficient but is also inexpensive. As a result, the present inventors have discovered that the incorporation of an ester having two cyclohexyl rings or its derivative, or said ester in combination with a branched poly-α-olefin, can provide an economical, high-performance base oil fluid. The present invention is based on this discovery.

SUMMARY OF THE INVENTION

Synthetic lubricating fluids comprising (i) an ester or its derivative containing two cyclohexyl radicals obtained from a monohydric alcohol containing a cyclohexyl or $C_1$ to $C_8$ alkyl substituted cyclohexyl moiety and cyclohexane carboxylic acid; or (ii) the ester of (i) and from 1 to 70% by weight of at least one branched poly-α-olefin or its hydrogenation product.

DETAILED DESCRIPTION OF THE INVENTION

In accordance with a first embodiment of the present invention there is provided a synthetic lubricating fluid comprising an ester compound or its derivative of cyclohexanol with cyclohexanecarboxylic acid, represented by the following general formula

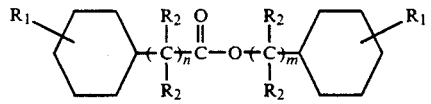

wherein n is an integer of 0 to 5 and m is an integer of 0 to 5, provided that n+m is 1 to 10, each $R_1$ may be the same or different and are each a hydrogen atom or an alkyl group having 1 to 8 carbon atoms, and each $R_2$ may be the same or different and is a hydrogen atom or an alkyl group having 1 to 3 carbon atoms. In a second embodiment of the present invention there is provided a synthetic lubricating fluid comprising the above mentioned ester compound or its derivative of cyclohexanol with cyclohexanecarboxylic acid and 1 to 70% by weight of a branched poly-α-olefin.

A first object of the present invention is to provide a synthetic lubricating fluid having excellent properties. A second object of the present invention is to provide a synthetic lubricating fluid which is not only economical but also readily available and easily applicable to transmissions.

The traction fluid of the present invention comprises an ester or its derivative having two cyclohexyl rings at both ends (hereinafter often referred to as "component A"), or said ester and a specific amount of a branched poly-α-olefin (hereinafter often referred to as "component B").

The component A is an ester represented by the above structural formula. In the formula n is an integer of 0 to 5 and m is an integer of 0 to 5, provided that n+m is 1 to 10. n is preferably an integer of 1 to 3, while m is preferably an integer of 1 to 3. When n+m is zero, the traction coefficient of the fluid is low while when the sum of n+m is 11 or more the viscosity of the fluid is unfavorably high. $R_1$ is a hydrogen atom or an alkyl group having 1 to 8 carbon atoms and is preferably a hydrogen atom or a methyl group. $R_2$ is a hydrogen atom or an alkyl group having 1 to 3 carbon atoms and is preferably a hydrogen atom. When $R_1$ is an alkyl group having 9 or more carbon atoms or when $R_2$ is an alkyl group having 4 or more carbon atoms the fluid is not only susceptible to decomposition but also has a viscosity which is too high.

The esters or their derivatives have a viscosity of 5 to 50 cst, particularly preferably 10 to 30 cst at 40° C. and 1 to 10 cst, particularly preferably 2 to 5 cst at 100° C. Examples of the derivatives of the esters include their amination products and ether compounds.

The ester can be produced by the following method. Specifically, the ester is produced by the esterification reaction of a monohydric alcohol with a cyclohexanecarboxylic acid compound. The monohydric alcohol compound is a compound having a cyclohexyl ring and is represented by the following structural formula:

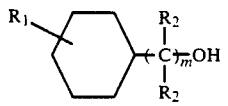

wherein $R_1$ is independently selected from hydrogen and alkyl groups having 1 to 8 carbon atoms, $R_2$ is independently selected from hydrogen or an alkyl group having 1 to 3 carbon atoms, and m is an integer of 0 to 5. A particularly preferred monohydric alcohol is a compound in which $R_2$ is hydrogen or a methyl group, $R_1$ is hydrogen or an alkyl group having 1 to 4 carbon atoms, and m is an integer of 0 to 2. Examples of such a compound include cyclohexanol, methylcyclohexanol, and cyclohexylcarbinol. The cyclohexanecarboxylic acid is a compound represented by the following structural formula:

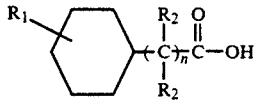

wherein $R_1$ is independently selected from hydrogen and alkyl groups having 1 to 8 carbon atoms, $R_2$ is independently selected from hydrogen or an alkyl group having 1 to 3 carbon atoms, and n is an integer of 0 to 5. A particularly preferred carboxylic acid is a compound in which $R_2$ is hydrogen or a methyl group, $R_1$ is hydrogen or an alkyl group having 1 to 4 carbon atoms, and n is an integer of 0 to 2. Examples of the carboxylic acid compounds include cyclohexanecarboxylic acid, cyclohexylacetic acid and cyclohexylpropionic acid. The esterification reaction is conducted in the presence of an excess amount of the alcohol using a catalyst, such as phosphoric acid, or in the presence of an excess amount of the acid. It is preferred that the esterification reaction be conducted in the presence of an excess amount of the acid. Specifically, 1 mol of the alcohol compound is reacted with 1.2 to 2 mol (particularly preferably 1.5 to 1.8 mol) of the acid. The reaction temperature is about 150° to 250° C., preferably 170° to 230° C., and the reaction time is 10 to 40 hr, preferably 15 to 25 hr. Although the esterification reaction may be conducted under either elevated or reduced pressures it is preferred that the reaction be conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds, water which has been formed during this reaction evaporates. The reaction is terminated when an equimolar amount, with respect to the alcohol, of the water has evaporated. The excess acid is neutralized with an aqueous alkaline solution and removed by washing with water. Phosphoric acid, p-toluenesulfonic acid, sulfuric acid or the like is used as the catalyst. The most preferred catalyst is phosphoric acid because it enhances the reaction rate and increases the yield of the ester. The reaction product is finally distilled under reduced pressure to remove water and the solvent, thereby obtaining the ester compound of the present invention.

The ester of the present invention per se exhibits a high traction coefficient. However, it may be blended with a second component, e.g., a poly-α-olefin such as polybutene or other ester, which provides a further improved traction fluid.

The poly-α-olefin as the second component has either a quaternary carbon atom or a tertiary carbon atom in its main chain and is a polymer of an α-olefin having 3 to 5 carbon atoms or the hydrogenation product thereof. Examples of the poly-α-olefins include polypropylene, polybutene, polyisobutylene and polypentene and the hydrogenation products thereof. Particularly preferred are polybutene and polyisobutylene and the hydrogenation products thereof. The polyisobutylene is represented by the following structural formula:

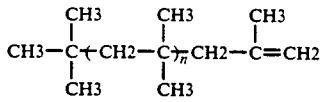

The hydrogenation product of the polyisobutylene is represented by the following structural formula:

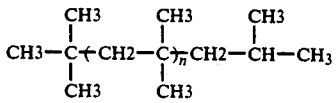

In the above formulae the degree of polymerization, n, is 6 to 200.

Although the polybutene and polyisobutylene are commercially available, they may also be produced by conventional polymerization methods. The hydrogenation product thereof is produced by reacting polyisobutylene or the like in the presence of hydrogen. The molecular weight of the poly-α-olefin is preferably in the range of 300 to 10,000, more preferably in the range of 500 to 5,000. The molecular weight can be adjusted by suitable methods such as decomposition of a poly-α-olefin having a high molecular weight and mixing of poly-α-olefins having different molecular weights. Although an α-olefin copolymer (OCP) is a kind of a poly-α-olefin, it is unsuited for use as component B in the present invention. This is because OCP is obtained by polymerization of two or more α-olefins and has a structure in which these α-olefins are irregularly linked, as opposed to polybutene etc., which have a regular gem-dialkyl structure.

In the present invention an ester having at least two cyclohexyl rings and 1 to 3 ester linkages (hereinafter referred to as "ester B") may also be used as the second component. Examples of the ester B include a monoester, diester or triester obtained by the esterification of a cyclohexanol compound with a carboxylic acid. A particularly preferred ester B is a monoester or diester having 1 to 10 carbon atoms in its center and having one cyclohexyl ring at each end.

The detailed structure and process for preparation of the ester B are described in (Japanese Patent Application Nos. 27832/1985, 294424/1985, and 19226/1986), having the same inventors as in the instant application, all of which are incorporated herein by reference.

The ester of the present invention, e.g., a monoester of cyclohexylacetic acid with cyclohexyl carbinol, exhibits a traction coefficient of 0.104 to 0.106; the component B, e.g., polybutene, exhibits a traction coefficient of 0.075 to 0.085; and the ester B (a monoester of cyclohexanecarboxylic acid with cyclohexanol) exhibits a traction coefficient of 0.090 to 0.092.

Since the ester (first component) of the present invention exhibits a high traction coefficient, its use alone in a traction drive results in a high performance. However, a further improved traction fluid can be obtained by blending with said first component 0.1 to 95% by weight, particularly 10 to 70% by weight, of the second component comprised of a poly-α-olefin or ester B. Specifically, although the traction coefficient of the second component is equal to or lower than that of component A the gemdialkyl group or cyclohexyl ring of the second component cooperates with the cyclohexyl ring of the first component to produce a synergistic effect with respect to improvement in traction coefficient. Further, since the second component is relatively inexpensive and has excellent viscosity characteristics a traction fluid can be economically obtained by blending the first component with 0.1 to 95% by weight of the second component without lowering the traction coefficient.

Various additives may also be added to the traction fluid of the present invention depending on its applications. Specifically, when the traction device operates at high temperatures and large loads at least one additive selected from among an antioxidant, a wear inhibitor and a corrosion inhibitor may be added in an amount of 0.01 to 5% by weight. Similarly, when a high viscosity index is required a known viscosity index improver is added in an amount of to 10% by weight. However, since the use of polyacrylate and olefin copolymer unfavorably lowers the traction coefficient, if they are present it is preferred that they be used in an amount of 4% by weight or less.

The term "synthetic lubricating fluid or traction fluid" as employed in the present invention is intended to mean a fluid used in devices which transmit a rotational torque through spot contact or line contact, or used in transmissions having a similar structure. The synthetic lubricating fluid of the present invention exhibits a traction coefficient higher than those of conventionally known fluids, i.e., exhibits a traction coefficient by 5 to 15% higher than those of the conventional fluids, although the value varies depending on the viscosity. Therefore, the synthetic lubricating fluid of the present invention can be advantageously used for relatively low power drive transmissions including internal combustion engines of small passenger cars, spinning machines and food producing machines, as well as large power drive transmissions such as industrial machines, etc.

The synthetic lubricating fluid of the present invention is remarkably superior in traction coefficient to conventional fluids. The reason why the traction fluid of the present invention exhibits a high traction coefficient is not yet fully understood. However, basically, the reason is believed to reside in the unique molecular structure of the synthetic lubricating fluid of the present invention.

The synthetic lubricating fluid (first component) of the present invention is an ester having two cyclohexyl rings in its molecule. The ester linkages bring about an interdipolar force between the molecules. It is believed that the interdipolar force serves to bring the fluid into a stable glassy state under high load conditions, thereby increasing the shearing force. Further, when the ester of the present invention is blended with the second component this second component possesses a gem-dialkyl quaternary carbon atom or a cyclohexyl ring. Therefore, when the traction device is under high load conditions the cyclohexyl rings of the first component are firmly engaged, like gears, with the gem-dialkyl portion or cyclohexyl ring of the second component, while when the device is released from the load the engagement is quickly broken, thereby causing fluidization.

The following examples are provided for illustrative purposes only and are not to be construed as limiting the invention herein described.

EXAMPLES 1 to 19

Ester $A_1$ according to the present invention was synthesized by the following method. Cyclohexylacetic acid and cyclohexylcarbinol (in 3:1 mole ratio) were charged into a reactor, followed by addition of 6 g phosphoric acid as a solvent. The reactor was then heated at 200° C., and the contents of the reactor were allowed to react under atmospheric pressure. The heating was stopped at a point when the amount of water generated during the reaction was twice by mol the amount of the cyclohexylacetic acid.

The reaction mixture was washed with an alkaline solution to remove unreacted compounds, i.e., cyclohexylacetic acid and cyclohexylcarbinol, from a mixture of the reaction product i.e., an ester of cyclohexylacetic acid with cyclohexylcarbinol, and the unreacted compounds, followed by vacuum distillation, thereby isolating a pure ester $A_1$.

In the same manner as described above esters $A_2$ and $A_3$ of the present invention were synthesized using the following raw materials:

$A_2$ . . . cyclohexylcarboxylic acid and cyclohexylcarbinol ($n=1$, $m=0$ in the aforementioned structural formula)

$A_3$ . . . cyclohexylacetic acid and cyclohexanol ($n=0$, $m=1$ in the aforementioned structural formula)

The traction coefficients of the following were determined: neat esters $A_1$ $A_2$ and $A_3$; and blends of these esters with (i) hydrogenated polybutene ($B_1$) having an average molecular weight of 1350, (ii) polybutene ($B_2$) having an average molecular weight of 900, and (iii) polybutene ($B_3$) having an average molecular weight of 2350 or polybutene ($B_4$) having an average molecular weight of 420. The measurement conditions for determining traction coefficient are shown below.

measurement equipment: Soda-type four roller traction testing machine.

test conditions: a fluid temperature of 20° C.; a roller temperature of 30° C.; a mean Hertzian pressure of 1.2 GPa; a rolling velocity of 3.6 m/s; and a percent slipping ratio of 3.0%.

As illustrated by the data in Table 1 the synthetic lubricating fluids of the this invention are superior in traction performance to the conventional fluids tested.

COMPARATIVE EXAMPLES 1-6

For comparison, the traction coefficients of a traction fluid consisting of neat polybutene (i.e., 100 weight percent) and a commercially available traction fluid were measured under the same conditions as described in the above Examples.

The results are shown in Table 1. As can be seen from Table 1, all the comparative samples exhibited traction coefficients 5 to 15% lower than those of the synthetic lubricating fluids of the present invention.

TABLE 1

| | A Loadings | | B Loadings | | Viscosity (Cst) 40° C. | Viscosity (Cst) 100° C. | Viscosity index | Traction coefficient |
|---|---|---|---|---|---|---|---|---|
| Ex. 1 | A1 | 100 | | — | 20.30 | 3.59 | 14.7 | 0.105 |
| 2 | A2 | 100 | | — | 12.78 | 2.83 | 42.4 | 0.100 |
| 3 | A3 | 100 | | — | 11.25 | 2.64 | 48.3 | 0.105 |
| 4 | A1 | 90 | B1 | 10 | 39.10 | 5.25 | 40.5 | 0.110 |
| 5 | A1 | 80 | ↓ | 20 | 67.93 | 8.52 | 94.9 | 0.115 |
| 6 | A1 | 70 | ↓ | 30 | 129.2 | 13.18 | 95.4 | 0.113 |
| 7 | A2 | 90 | ↓ | 10 | 22.93 | 4.40 | 100.0 | 0.103 |
| 8 | A2 | 80 | ↓ | 20 | 44.54 | 7.04 | 116.7 | 0.106 |
| 9 | A2 | 70 | ↓ | 30 | 90.09 | 11.27 | 112.7 | 0.106 |
| 10 | A2 | 60 | ↓ | 40 | 183.9 | 18.36 | 110.8 | 0.104 |
| 11 | A3 | 90 | ↓ | 10 | 20.30 | 4.12 | 102.7 | 0.108 |
| 12 | A3 | 80 | ↓ | 20 | 39.81 | 6.62 | 120.2 | 0.111 |
| 13 | A3 | 70 | ↓ | 30 | 79.81 | 10.62 | 118.2 | 0.109 |
| 14 | A3 | 60 | ↓ | 40 | 161.2 | 17.15 | 114.5 | 0.105 |
| 15 | A1 | 80 | B2 | 20 | 61.4 | 8.41 | 107 | 0.108 |
| 16 | A1 | 70 | ↓ | 30 | 168.6 | 14.77 | 84 | 0.104 |
| 17 | A1 | 90 | B3 | 10 | 50.6 | 8.60 | 147 | 0.110 |
| 18 | A1 | 80 | ↓ | 20 | 187.4 | 22.44 | 145 | 0.107 |
| 19 | A1 | 35 | B4 | 65 | 52.3 | 6.58 | 66.7 | 0.097 |
| Comp. Ex. 1 | — | | B1 | 100 | 33,000 | 700 | — | 0.080 |
| 2 | — | | B4 | 100 | 85 | 9 | 73.3 | 0.079 |
| 3 | high-viscosity traction base oil | | | | 8.6 | 2.1 | 25 | 0.086 |
| 4 | medium-viscosity traction base oil | | | | 41.0 | 4.8 | −41 | 0.096 |
| 5 | low-viscosity traction base oil | | | | 69.6 | 5.9 | −66 | 0.090 |
| 6 | Santotrack ® | | | | 13.8 | 2.99 | 46 | 0.087 |

The present invention is directed to a synthetic lubricating fluid containing a base oil comprised of an ester having two cyclohexyl rings, or said ester and a specific amount of a poly-α-olefin blended therewith. The synthetic lubricating oil not only exhibits an extremely high traction coefficient but is also inexpensive and has excellent viscosity characteristics.

Therefore, the use of the traction fluid of the present invention in a power transmission, particularly a traction drive device, leads to a remarkable increase in shearing force under a high load. This enables the reduction in size of the device resulting in a reduction in cost of said device.

What is claimed is:

1. A synthetic traction fluid comprising:

(i) at least one ester or its derivative represented by the formula

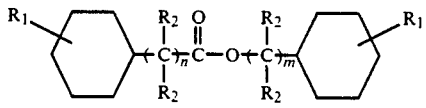

wherein n is an integer of 0 to 5 and m is an integer of 0 to 5, with the proviso that the sum of n+m is 1 to 10, $R_1$ is independently selected from hydrogen and $C_1$ to $C_8$ alkyl groups, and $R_2$ is independently selected from hydrogen and $C_1$ to $C_3$ alkyl groups; and (ii) at least one of antioxidant, wear inhibitor, and corrosion inhibitor in an amount of 0.01 to 5 weight %.

2. The fluid of claim 1 wherein n is an integer of 1 to 3.

3. The fluid of claim 1 wherein m is an integer of 1 to 3.

4. The fluid of claim 1 wherein $R_1$ is independently selected from hydrogen and $C_1$ to $C_3$ alkyl groups.

5. The fluid of claim 1 wherein $R_2$ is independently selected from hydrogen and methyl.

6. A synthetic traction fluid comprising:

(i) at least one ester or its derivative represented by the formula

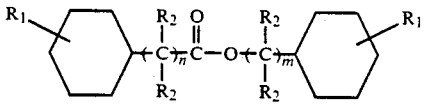

wherein n is an integer of 0 to 5 and m is an integer of 0 to 5, with the proviso that the sum of n+m is 1 to 10, $R_1$ is independently selected from hydrogen and $C_1$ to $C_8$ alkyl groups, and $R_2$ is independently selected from hydrogen and $C_1$ to $C_3$ alkyl groups; and (ii) from 0.1 to 95% by weight of at least one branched poly-α-olefin or its hydrogenation product.

7. The fluid of claim 6 wherein said poly-α-olefin has an average molecular weight of 500 to 10,000.

8. The fluid of claim 7 wherein said poly-α-olefin has an average molecular weight of 900 to 5,000.

9. The fluid of claim 6 which contains from 10 to 70% by weight of said poly-α-olefin.

10. The fluid of claim 7 which contains from 10 to 70% by weight of said poly-α-olefin.

11. The fluid of claim 6 wherein n is an integer of 1 to 3.

12. The fluid of claim 6 wherein $R_1$ is independently selected from hydrogen and $C_1$ to $C_4$ alkyl groups.

13. The fluid of claim wherein $R_2$ is independently selected from hydrogen and methyl.

* * * * *